US011428220B2

(12) United States Patent
McGehee

(10) Patent No.: US 11,428,220 B2
(45) Date of Patent: Aug. 30, 2022

(54) FRAME-SUPPORTED PUMP

(71) Applicant: Phoenix Composites Equipment, Inc., Largo, FL (US)

(72) Inventor: Scott McGehee, Largo, FL (US)

( * ) Notice: Subject to any disclaimer, the term of this patent is extended or adjusted under 35 U.S.C. 154(b) by 134 days.

(21) Appl. No.: 16/878,921

(22) Filed: May 20, 2020

(65) Prior Publication Data

US 2021/0363987 A1 Nov. 25, 2021

(51) Int. Cl.
*F04B 53/22* (2006.01)
*F04B 53/16* (2006.01)

(52) U.S. Cl.
CPC ..... *F04B 53/22* (2013.01); *F04B 53/16* (2013.01); *F05B 2230/60* (2013.01); *F05B 2240/90* (2013.01); *F05B 2260/30* (2013.01)

(58) Field of Classification Search
CPC ..... F04B 53/22; F04B 53/16; F05B 2230/60; F05B 2240/90; F05B 2260/30
See application file for complete search history.

(56) References Cited

U.S. PATENT DOCUMENTS 4,635,621 A * 1/1987 Atkinson ..... A61M 3/0258 601/161
4,775,303 A * 10/1988 Liska ..... F04B 53/164 277/522
6,000,916 A 12/1999 Martin et al.
6,925,926 B2 8/2005 Weinberger et al.
9,068,567 B2 * 6/2015 Hitter ..... F04B 53/16
9,962,663 B2 5/2018 Kimberlin et al.
2012/0209243 A1 * 8/2012 Yan ..... B05B 1/202 604/500
2015/0308710 A1 * 10/2015 McCormick ..... F24H 1/142 239/135
2019/0263652 A1 8/2019 Cohen et al.
2020/0001312 A1 1/2020 Yin et al.

* cited by examiner

*Primary Examiner* — Connor J Tremarche

(57) ABSTRACT

The frame-supported pump is assembled without the use of tools. In place of bolts or threaded connections, an external frame provides the support necessary to resist the internal pressure of the pump. Upper and lower pump housings include grooves that slide into a slotted support or frame—a slip-in mount. In alternative embodiments the grooves are replaced with holes that slide over rods, or other means of external support prevent the pump housings from moving away from each other during pumping. A pin is optionally used to prevent the housings from sliding out of the frame, or friction is sufficient. When the pumps are in service, the internal pressure attempts to push the housings away from each other, but this force is passed to the frame, which responds with a matching force, keeping the housings in place.

16 Claims, 8 Drawing Sheets

FRAME-SUPPORTED PUMP

FIELD

This invention relates to the field of pumps and more particularly to a pump for difficult service that can be disassembled without tools.

BACKGROUND

Piston pumps are often used for extreme service. For example, pumping epoxies, silicones, and other viscous adhesive-type materials.

Given the high pressures and difficult fluids, these pumps often leak. This leakage of adhesive-type materials, plus time for the materials to thicken, cure, or dry, makes servicing the pump difficult.

This difficulty is exacerbated by the many fasteners commonly used to hold these pumps together. The fasteners are covered up, glued in placed, and difficult to access. As a result, the fasteners are difficult to remove and thus the pump is difficult to clean.

What is needed is a pump that can be readily assembled, operated, and disassembled without requiring the use of fasteners.

SUMMARY

The frame-supported pump is assembled without the use of tools. In place of bolts or threaded connections, an external frame provides the support necessary to resist the internal pressure of the pump.

Upper and lower pump housings include grooves that slide into a slotted support or frame—a slip-in mount. In alternative embodiments the grooves are replaced with holes that slide over rods, or other means of external support prevent the pump housings from moving away from each other during pumping.

A pin can be optionally used to prevent the housings from sliding out of the frame, but friction is usually sufficient.

When the pumps are in service, the internal pressure attempts to push the housings away from each other, but this force is passed to the frame, which responds with a matching force, keeping the housings in place.

Disassembly and maintenance can be performed without tools because the pump housing is not held together by connecting rods, bolts, or latches, as it would be in more conventional pumps. Rather, the optional pins are removed, and the pumps are slid outward from the slots. The pumps can then be pulled apart, with the housings sliding away from the piston enclosure/cylinder.

Given the ease of disassembly, the pumps are easily reconfigured for use with different internal parts, or when used with multiple pumps, individual pumps are easily swapped with pumps of differing size to allow for unique pump configurations.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
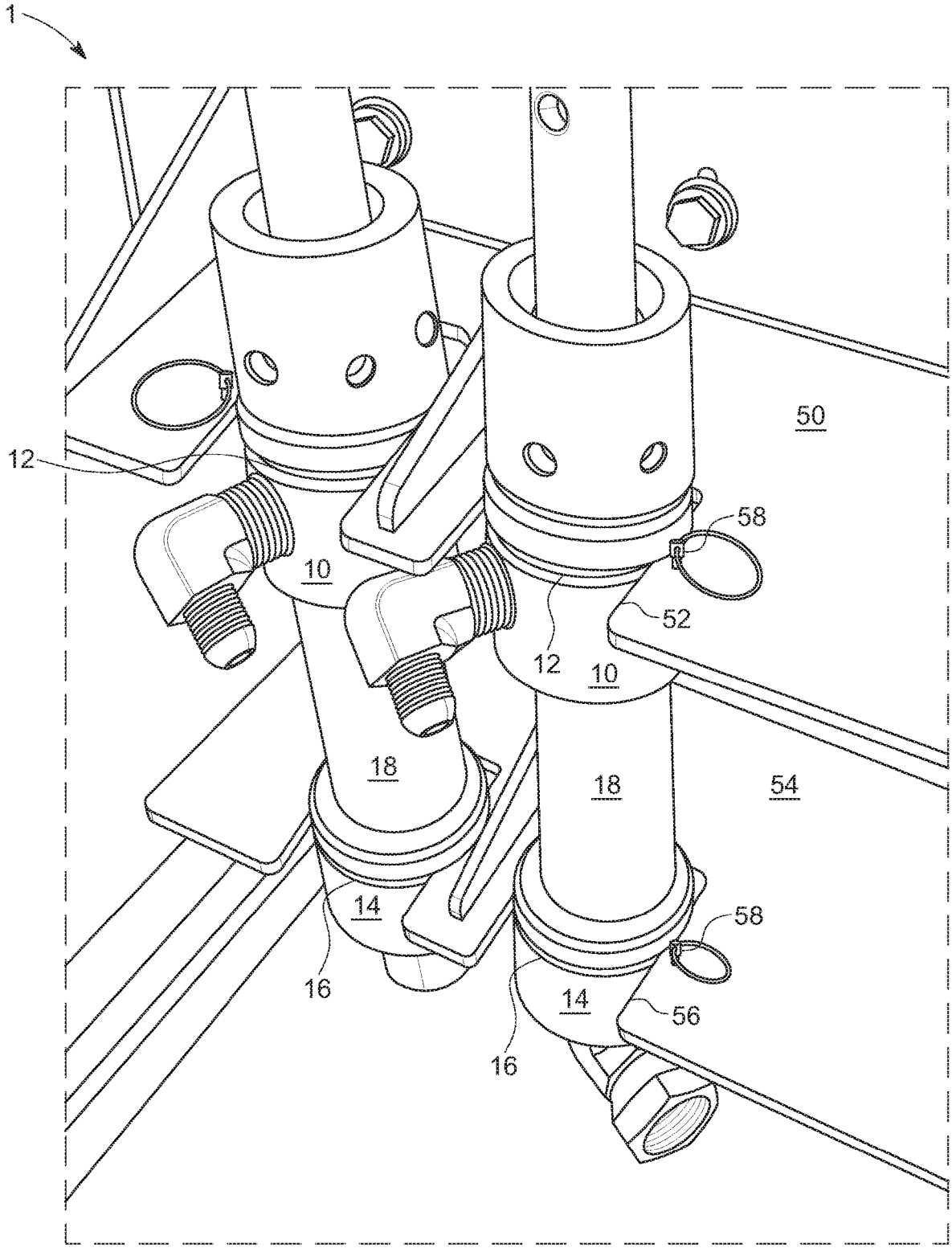
FIG. 1 illustrates a first view of the frame-supported pump with locking mechanism installed.

Reference will now be made in detail to the presently preferred embodiments of the invention, examples of which are illustrated in the accompanying drawings. Throughout the following detailed description, the same reference numerals refer to the same elements in all figures.

Figure 2:
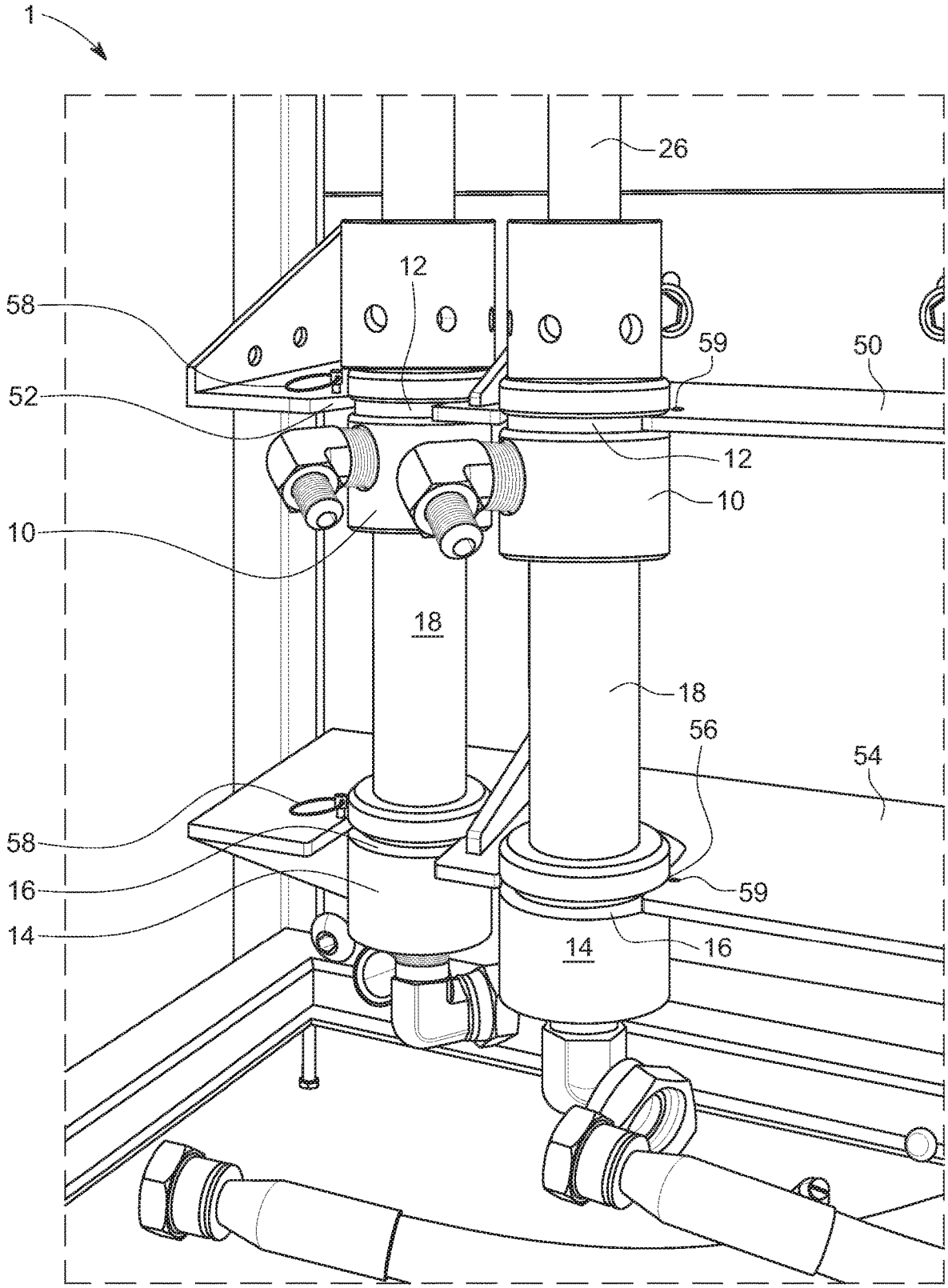
FIG. 2 illustrates a second view of the frame-supported pump with locking mechanism partially removed.

Referring to FIGS. 1 and 2, a first and second view of the frame-supported pump with optional locking mechanism installed is shown.

The frame-supported pump 1 includes an upper outlet housing 10 with upper outlet housing groove 12. The upper outlet housing groove 12 interfaces with the upper pump channel 52 of the upper frame 50.

The lower inlet housing 14 includes a lower inlet housing groove 16, the lower inlet housing groove interfacing with the lower pump channel 56 of the lower frame 54.

Between the upper outlet housing 10 and the lower inlet housing 14 is the piston enclosure or pump cylinder 18, inside of which are the mechanical portions of the frame-supported pump 1 that perform the pumping operations.

Optional locking pins 58 are shown in locking pin holes 59. The optional locking pins 58 ensure the frame-supported pump 1 does not slide out of the upper pump channel 52 or lower pump channel 56 during pumping.

The right-most pump in FIG. 2, is shown partially removed, the optional pins 58 removed from the holes 59, the housings 10/14 partially slid out of the frames 50/54.

Figure 3:
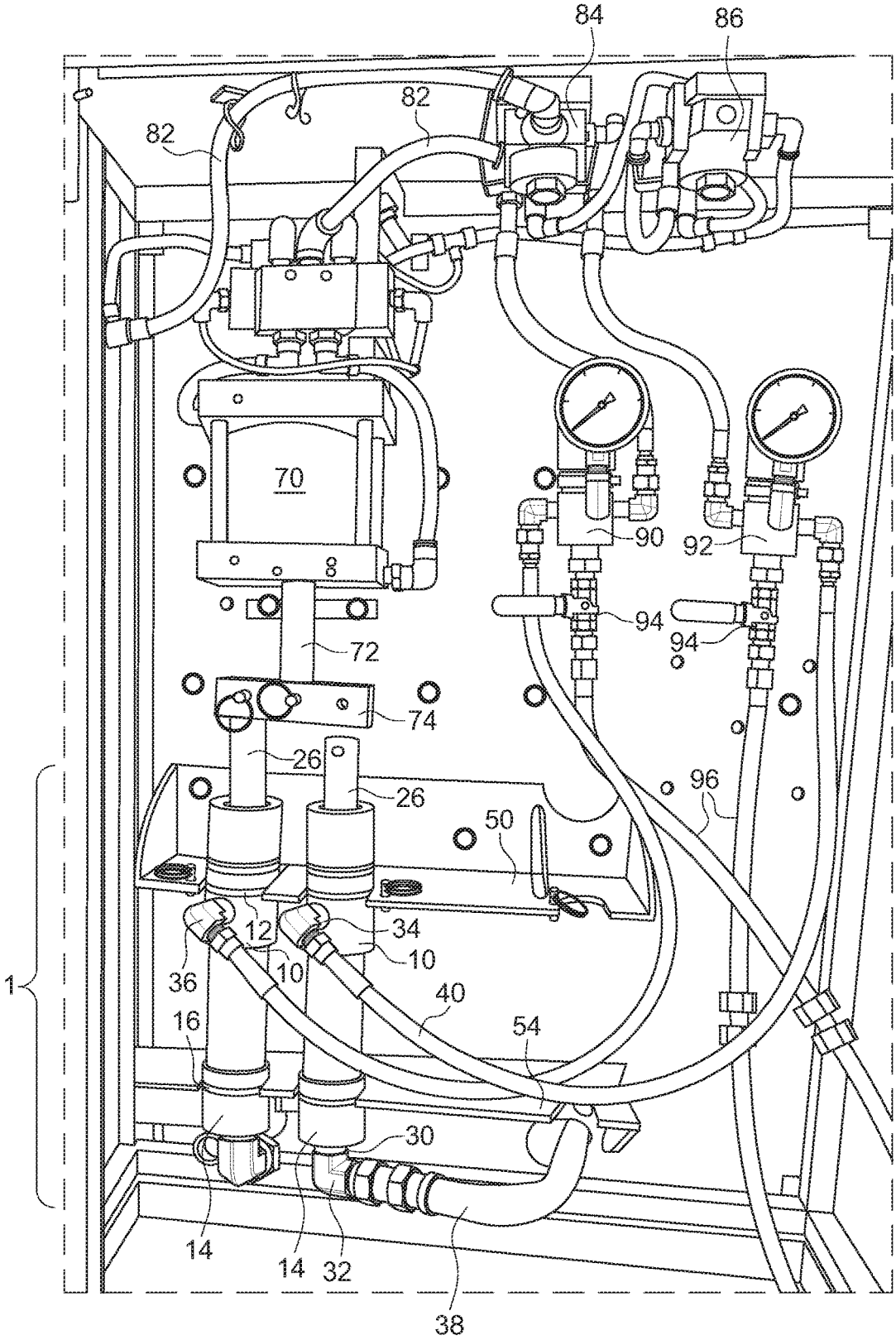
FIG. 3 illustrates a view of the primary and associated components of the frame-supported pump.

Referring to FIG. 3, a view of the primary and associated components of the frame-supported pump is shown.

The frame-supported pump 1 is generally used as part of a larger system.

Each frame-supported pump 1 includes an inlet 30 with inlet fitting 32, and discharge 34 with discharge fitting 36.

Inlet tubing 38 connects to the inlet fitting 32, with discharge tubing 40 connected to the discharge fitting 36.

The discharge tubing 40 connects to the associated first or second pressure indicating manifold 90/92, each associated with a pressure dump valve 94 releasing to a pressure dump line 96 for relieving pressure from the system.

The pump shafts 26 of each frame-supported pump 1 are optionally connected to a shaft splitter 74, in turn connected to the air motor shaft 72 of the air motor 70.

The air motor 70 is supplied by pressurized air entering through the primary regulator 80 (see FIG. 8), passing through the compressed air line 82, through the first pneumatic regulator 84 before supplying the air motor 70. The second pneumatic regulator 86 provides a regulated source of air for downstream tools (not shown).

Figure 4:
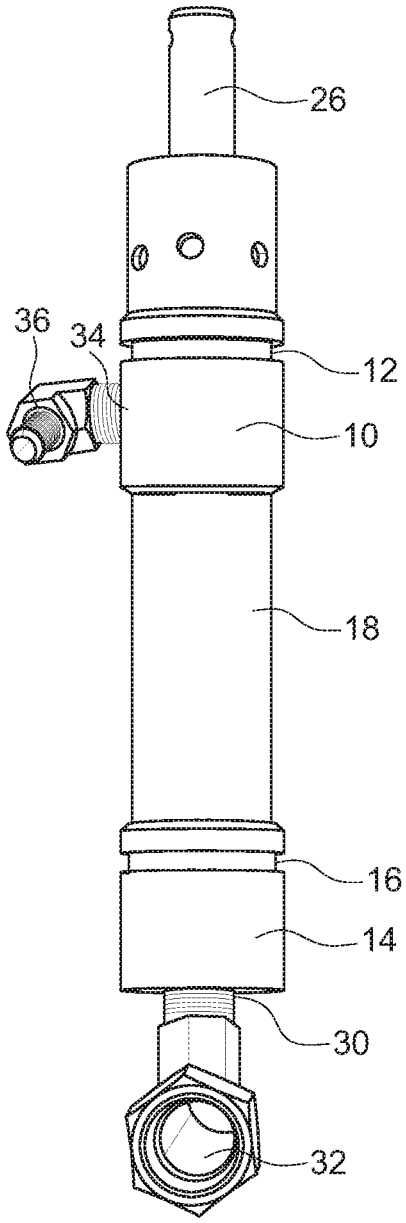
FIG. 4 illustrates an assembled view of the frame-supported pump removed from the frame.
Figure 5:
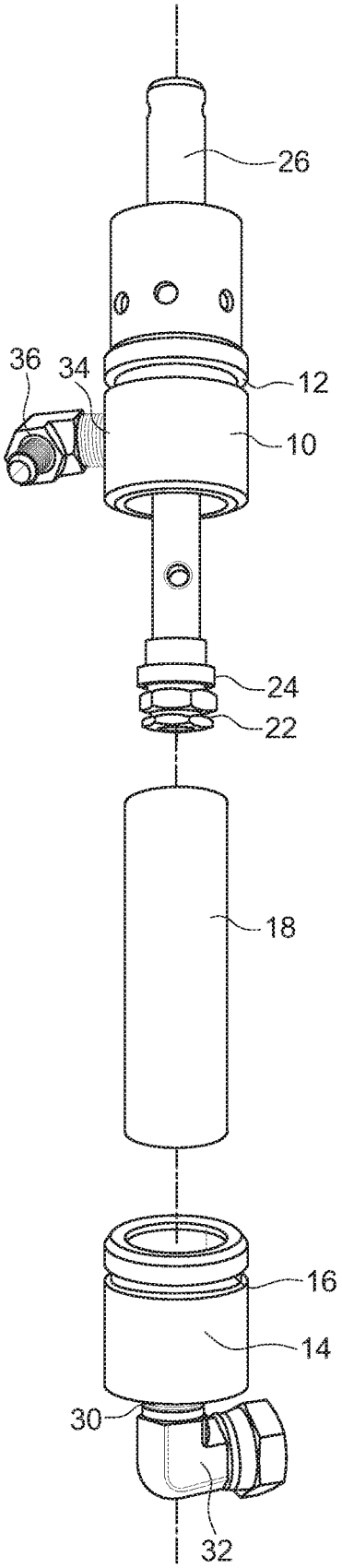
FIG. 5 illustrates a disassembled view of the frame-supported pump removed from the frame.

Referring to FIGS. 4 and 5, an assembled view and disassembled view of the frame-supported pump removed from the frame are shown.

The pump shaft 26 leads into the upper outlet housing 10 with upper outlet housing groove 12. Also included is lower inlet housing 14 with lower inlet housing groove 16.

The piston enclosure or pump cylinder 18 surrounds the pump shaft 26, valve 22, and seal 24.

The inlet 30 with inlet fitting 32 and discharge 34 with discharge fitting 36 are also shown.

Figure 6:
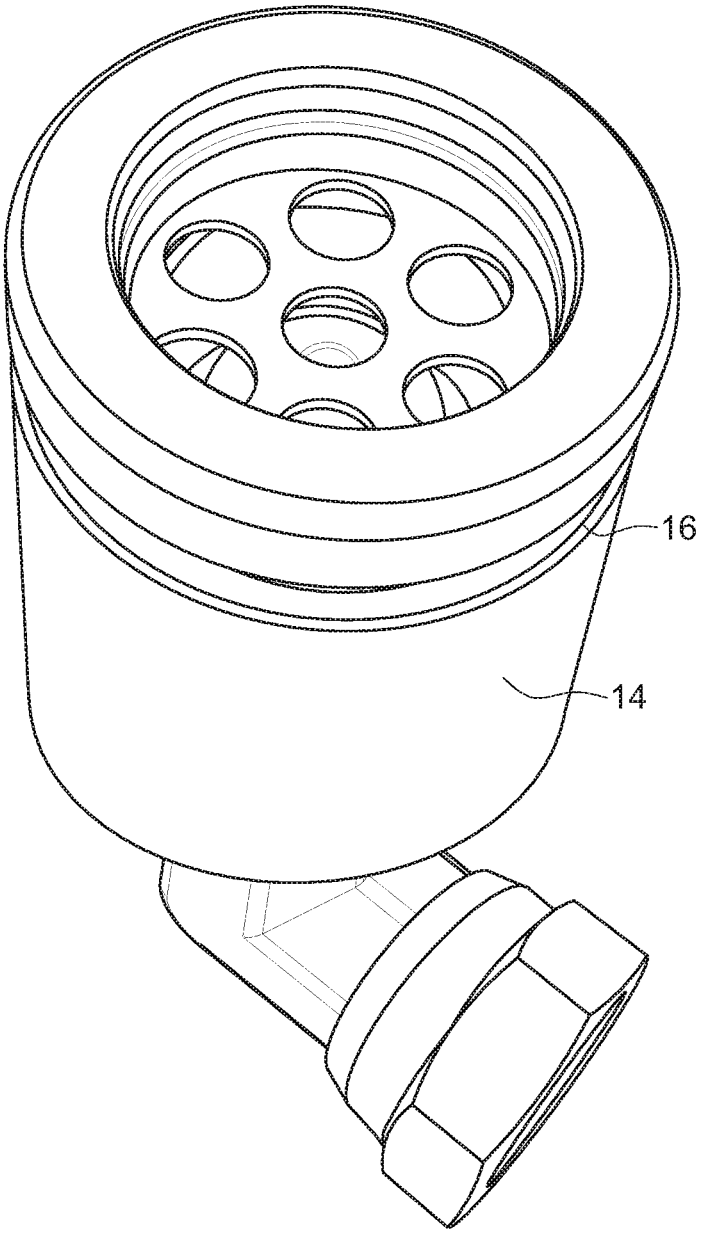
FIG. 6 illustrates a view of a lower inlet housing of the frame-supported pump.

Referring to FIG. 6, a view of a top of the lower housing of the frame-supported pump is shown.

The lower inlet housing 14 is shown with circumferential lower inlet housing groove 16.

Figure 7:
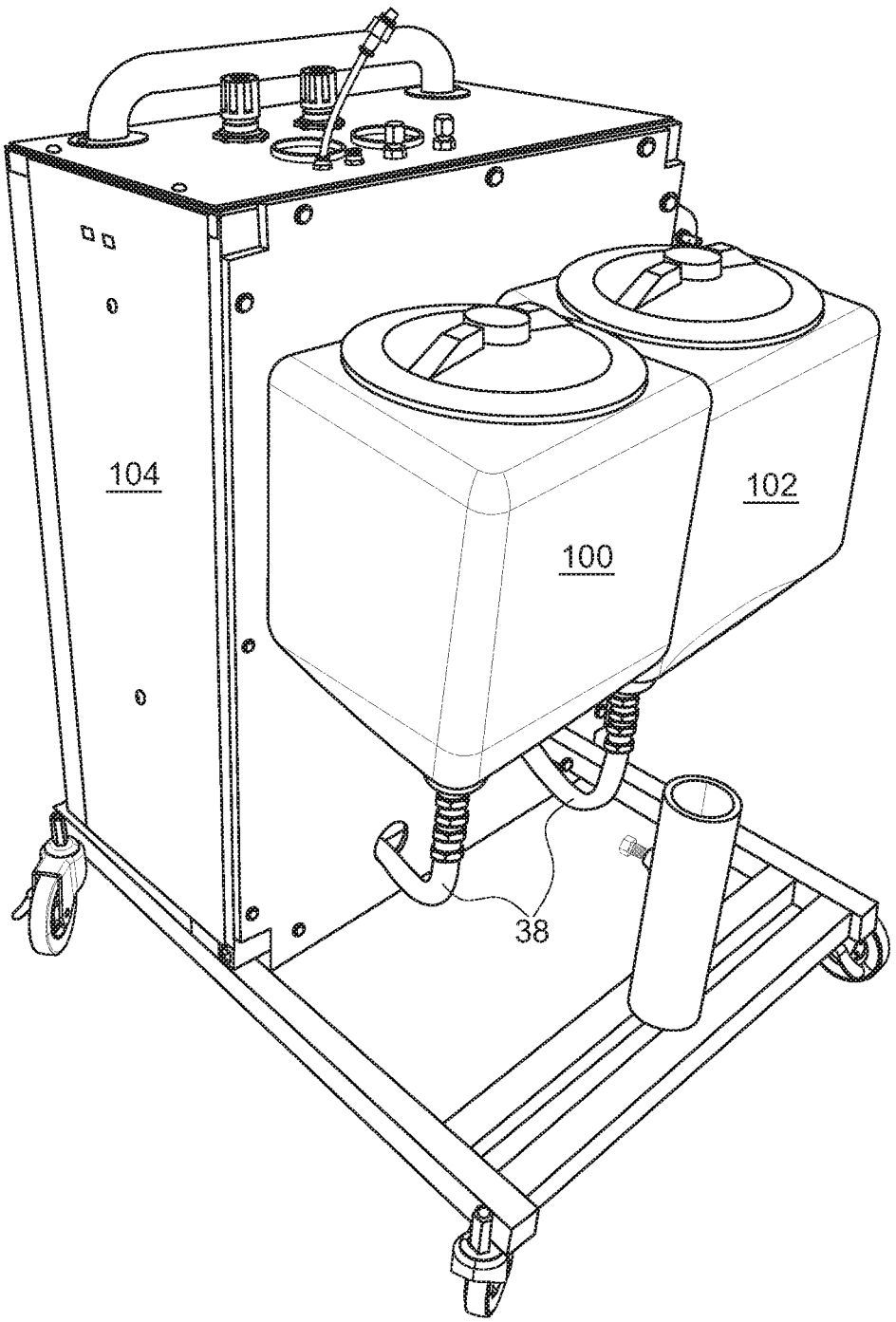
FIG. 7 illustrates a first view of the enclosure of the frame-supported pump.
Figure 8:
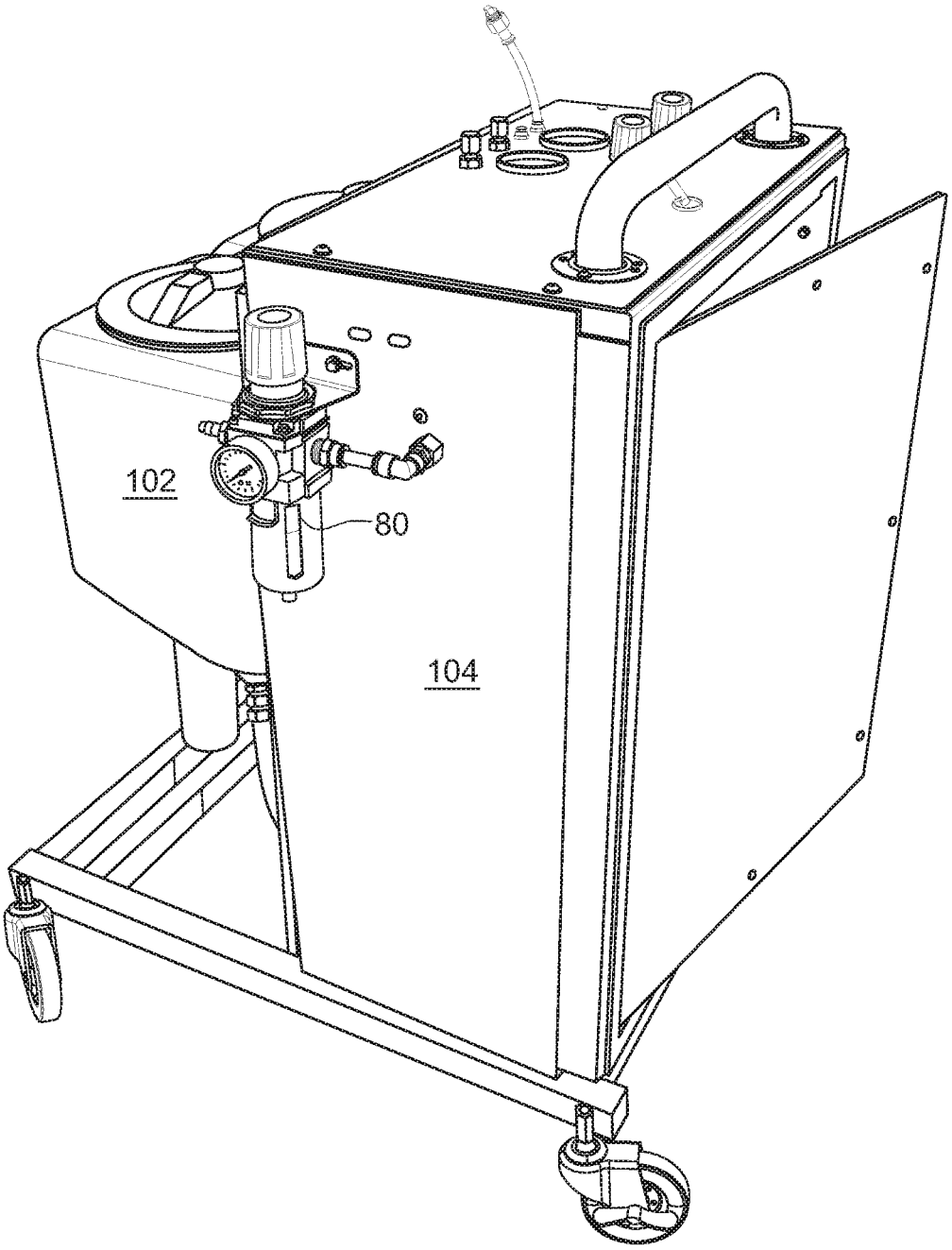
FIG. 8 illustrates a first view of the enclosure of the frame-supported pump.

Referring to FIGS. 7 and 8, a first and second view of the enclosure of the frame-supported pump are shown.

The first fluid container 100 and second fluid container 102 are shown, connected to enclosure 104. Inlet tubing 38 leads from the fluid containers 100/102 to the pumps 1. Also shown is the primary regulator 80 where a source of compressed air is connected.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A piston pump comprising: an upper housing; a lower housing; the upper housing separate from the lower housing; a frame; the upper housing sliding into the frame; the lower housing sliding into the frame; whereby the frame provides compressive force to resist an internal pressure pushing the upper housing away from the lower housing; the upper housing includes an upper housing groove; the upper housing groove interfacing with the frame; the lower housing includes a lower housing groove; the lower housing groove interfacing with the frame; whereby the upper housing and lower housing are held in position by the frame during use, but can be slid out of the frame for disassembly.

2. The piston pump of claim 1, wherein the frame includes: an upper pump channel; and a lower pump channel; wherein the upper housing groove interfaces with the upper pump channel and the lower housing groove interfaces with the lower pump channel; whereby the upper housing and lower housing slide in and out of the frame.

3. The piston pump of claim 2, further comprising:
removable pins placed in holes in the frame;
the holes adjacent to the upper pump channel and the lower pump channel;
whereby when the removable pins are placed in the holes the removable pins obstruct removal of the upper housing and the lower housing from the frame.

4. The piston pump of claim 1, further comprising:
a piston enclosure between the upper housing and the lower housing;
the piston enclosure surrounding a piston;
the piston acting to pump fluids during operation of the piston pump.

5. The piston pump of claim 1, wherein:
the upper housing includes a discharge;
the lower housing includes an inlet;
whereby fluid flows into the inlet, through the lower housing, through the upper housing, and out of the discharge.

6. A pump held together without threaded fasteners, the pump comprising:
a frame;
a pump housing;
the pump housing formed from an upper housing and a lower housing, the lower housing separate from the upper housing;
an upper groove in the pump housing;
a lower groove in the pump housing;
the upper groove interfacing with the frame;
the lower groove interfacing with the frame;
whereby the frame interacts with the upper groove and lower groove to resist an outward pressure of the pump during operation.

7. The pump held together without threaded fasteners of claim 6, wherein the frame includes:
an upper pump channel; and
a lower pump channel;
wherein the upper groove interfaces with the upper pump channel and the lower groove interfaces with the lower pump channel;
whereby the pump housing slides in and out of the frame.

8. The pump held together without threaded fasteners of claim 7, further comprising:
removable pins placed in holes in the frame;
the holes adjacent to the upper pump channel and the lower pump channel;
whereby the removable pins obstruct removal of the pump when the removable pins are within the holes.

9. The pump held together without threaded fasteners of claim 6, further comprising:
a cylinder within the pump housing;
the cylinder surrounding a piston;
the piston acting to pump fluids during operation of piston pump.

10. The pump held together without threaded fasteners of claim 6, wherein:
the pump housing includes a discharge and an inlet;
whereby fluid flows into the inlet, through housing, and out of the discharge.

11. The pump held together without threaded fasteners of claim 6, wherein the frame supports other components related to the pump, including an air motor.

12. A pump that can be disassembled without tools, the pump comprising: an upper housing; a lower housing, the lower housing separate from the upper housing; a piston enclosure; the piston enclosure between the upper housing and the lower housing; a frame that supports the pump; the upper housing and the lower housing slidably interfacing with the frame; the frame providing a compressive force to hold the upper housing and the lower housing against the piston enclosure; wherein when the combination of the upper housing, lower housing, and piston enclosure are removed from the frame, a user can pull the upper housing off the piston enclosure, and pull the lower housing off the piston enclosure, without use of any tools; the upper housing includes an upper housing groove; the upper housing groove interfacing with the frame; the lower housing includes a lower housing groove; the lower housing groove interfacing with the frame; whereby the upper housing and lower housing are held in position by the frame during use, but can be slid out of the frame for disassembly.

13. The pump that can be disassembled without tools of claim 12, wherein the frame includes: an upper pump channel; and a lower pump channel; wherein the upper housing groove interfaces with the upper pump channel and the lower housing groove interfaces with the lower pump channel; whereby the upper housing and lower housing slide in and out of the frame.

14. The pump that can be disassembled without tools of claim 12, further comprising: removable pins placed in holes in the frame; the holes adjacent to the upper pump channel and the lower pump channel; whereby the removable pins obstruct removal of the pump when the removable pins are set within the holes.

15. The pump that can be disassembled without tools of claim 12, wherein:

the upper housing includes a discharge;

the lower housing includes an inlet;

whereby fluid flows into the inlet, through the lower housing, through the upper housing, and out of the discharge.

16. The pump that can be disassembled without tools of claim 12, wherein the frame supports other components related to the pump, including an air motor.

* * * * *